US007552821B1

(12) United States Patent
Demers et al.

(10) Patent No.: US 7,552,821 B1
(45) Date of Patent: Jun. 30, 2009

(54) PUZZLE STORAGE AND SERVICE CASE

(76) Inventors: Fernand Demers, 6740 Water View Way, Dayton, OH (US) 45424-8126; Alberta E. Demers, 6740 Water View Way, Dayton, OH (US) 45424-8126

( * ) Notice: Subject to any disclaimer, the term of this patent is extended or adjusted under 35 U.S.C. 154(b) by 298 days.

(21) Appl. No.: 11/693,629

(22) Filed: Mar. 29, 2007

(51) Int. Cl.
*B65D 85/20* (2006.01)

(52) U.S. Cl. ..... 206/315.1; 206/499; 220/528; 220/525

(58) Field of Classification Search ..... 206/315.1, 206/514, 555; 446/75; 273/157 R; 220/23.87, 220/23.88, 23.89, 23.91
See application file for complete search history.

(56) References Cited

U.S. PATENT DOCUMENTS

| | | | | | |
|---|---|---|---|---|---|
| 3,504,915 | A * | 4/1970 | Walker | 273/157 R |
| 3,792,668 | A * | 2/1974 | Ward | 108/69 |
| 3,884,476 | A | 5/1975 | Sanders | |
| 4,436,307 | A * | 3/1984 | Caldwell | 273/157 R |
| 4,484,745 | A | 11/1984 | Sleeper | |
| 4,767,003 | A * | 8/1988 | Rice et al. | 206/719 |
| 4,865,325 | A * | 9/1989 | Stolz | 273/157 R |
| 5,429,372 | A | 7/1995 | Spaziani et al. | |
| 5,642,883 | A | 7/1997 | Rioux | |
| 5,651,547 | A | 7/1997 | Rannelli | |
| D400,600 | S | 11/1998 | Ackerman et al. | |
| 5,895,049 | A * | 4/1999 | Fingers, Jr. | 273/309 |
| 6,364,116 | B1 * | 4/2002 | Ng | 206/579 |
| 6,564,957 | B2 * | 5/2003 | Caldwell | 273/157 R |
| 6,928,932 | B1 | 8/2005 | Ferrill | |
| 2002/0163126 | A1 * | 11/2002 | Caldwell | 273/157 R |

* cited by examiner

*Primary Examiner*—Jacob K Ackun, Jr.
*Assistant Examiner*—King M Chu

(57) ABSTRACT

This patent discloses a container for carrying jigsaw puzzle pieces. The container may include a main tray having a handle and a main tray cavity. The container also may include an outer lid, an inner lid, a puzzle support, a first tray, a second tray, a first foam pad, and a second foam pad. The outer lid may be secured to the main tray by fasteners to form a container interior with the main tray cavity. The inner lid may be positioned within the main tray cavity and the puzzle support may removeably reside between the main tray and the inner lid. Both the first tray and the second tray may be positioned within the inner lid cavity and may include the first foam pad and second foam pad, respectively.

14 Claims, 8 Drawing Sheets

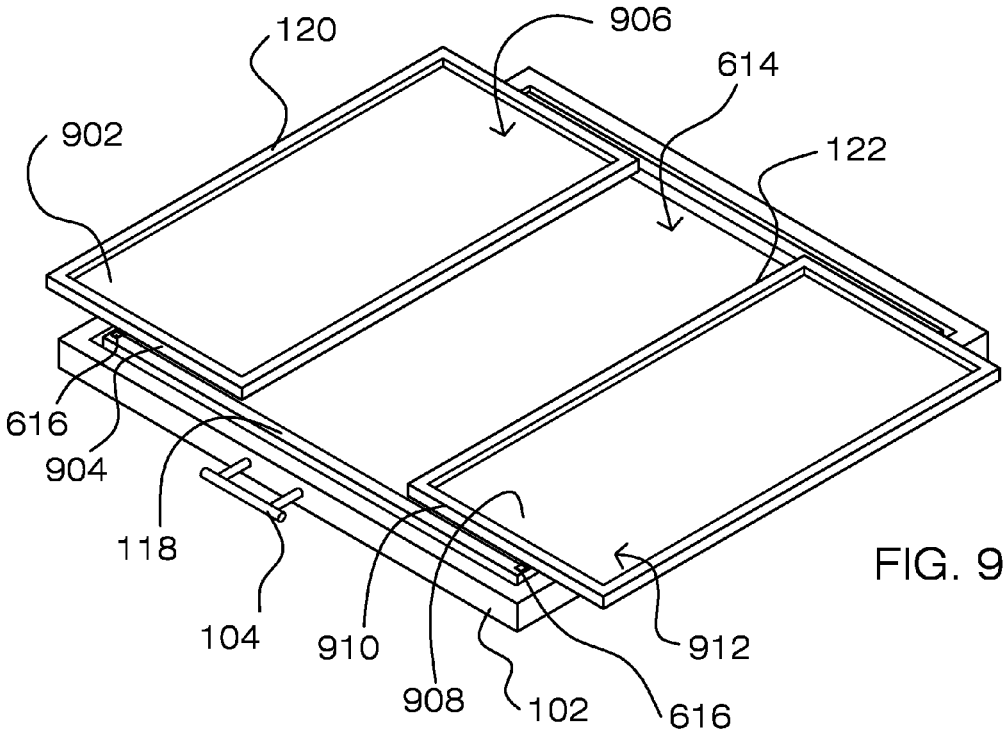
FIG. 9
FIG. 10
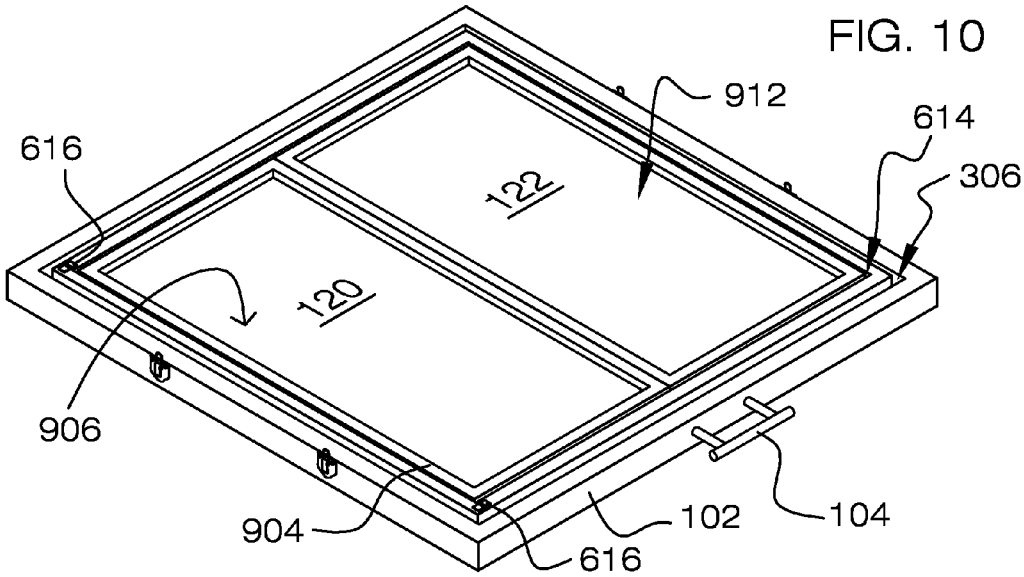

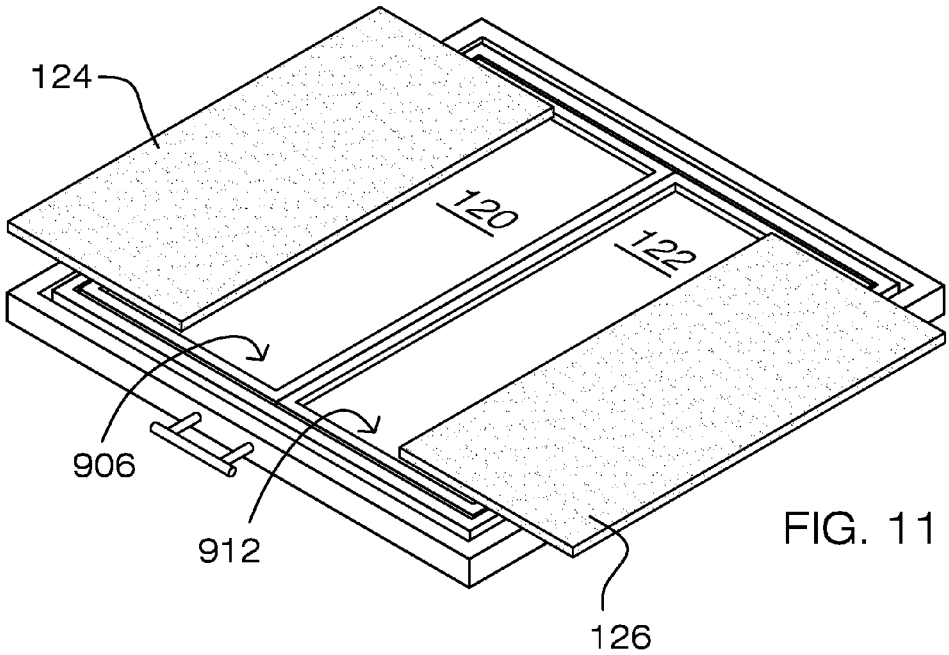
FIG. 11
FIG. 12
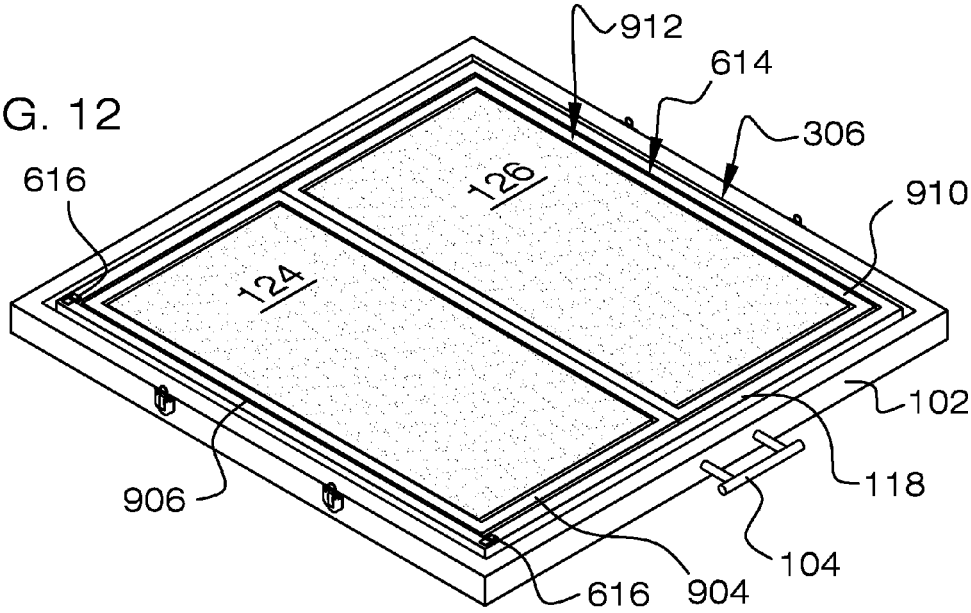

PUZZLE STORAGE AND SERVICE CASE

BACKGROUND

1. Field

The information disclosed in this patent relates to a portable container to store jigsaw puzzle pieces and to provide support in assembling the store jigsaw puzzle pieces.

2. Background Information

A jigsaw puzzle is a tiling puzzle that may require the assembly of numerous small, often oddly shaped, interlocking and tessellating pieces. Each piece may include a small part of a picture on it. When completely assembled, a jigsaw puzzle reveals a complete picture.

Jigsaw puzzles often include thousands of pieces and assembly of such puzzles may take more than one day. Usually jigsaw puzzles (often referred to as puzzles) are built on a flat surface, such as a kitchen table or a card table having foldable legs. Semi-completed puzzles usually are left on the kitchen table over night and puzzles on card table are stored under a bed after the legs of the card table are folded close.

Neither the kitchen table technique nor the card table technique is convenient. The kitchen table's use is limited while a puzzle remains on top and a puzzle cannot adequately be transported on a card table. Moreover, it is difficult to move and store a puzzle without damaged by an accidental bump or fall. Neither technique allows good display of a completed puzzle. What is needed is a portable container to store jigsaw puzzle pieces and to provide support in assembling the store jigsaw puzzle pieces.

SUMMARY

This patent discloses a container for carrying jigsaw puzzle pieces. The container may include a main tray having a handle and a main tray cavity. The container also may include an outer lid, an inner lid, a puzzle support, a first tray, a second tray, a first foam pad, and a second foam pad. The outer lid may be secured to the main tray by fasteners to form a container interior with the main tray cavity. The inner lid may be positioned within the main tray cavity and the puzzle support may removeably reside between the main tray and the inner lid. Both the first tray and the second tray may be positioned within the inner lid cavity and may include the first foam pad and second foam pad, respectively.

BRIEF DESCRIPTION OF THE FIGURES

FIG. 9 is an isometric view of first tray 120 and second tray 122 positioned relative to inner lid 118 and main tray 102.

FIG. 10 is an isometric view of first tray 120 and second tray 122 positioned in inner lid cavity 612 of inner lid 118.

FIG. 11 is an isometric view of first foam pad 124 and second foam pad 126 positioned relative to first tray 120 and second tray 122.

FIG. 12 is an isometric view of first foam pad 124 and second foam pad 126 positioned in first tray cavity 906 and second tray cavity 912, respectively.

DETAILED DESCRIPTION

Figure 1:
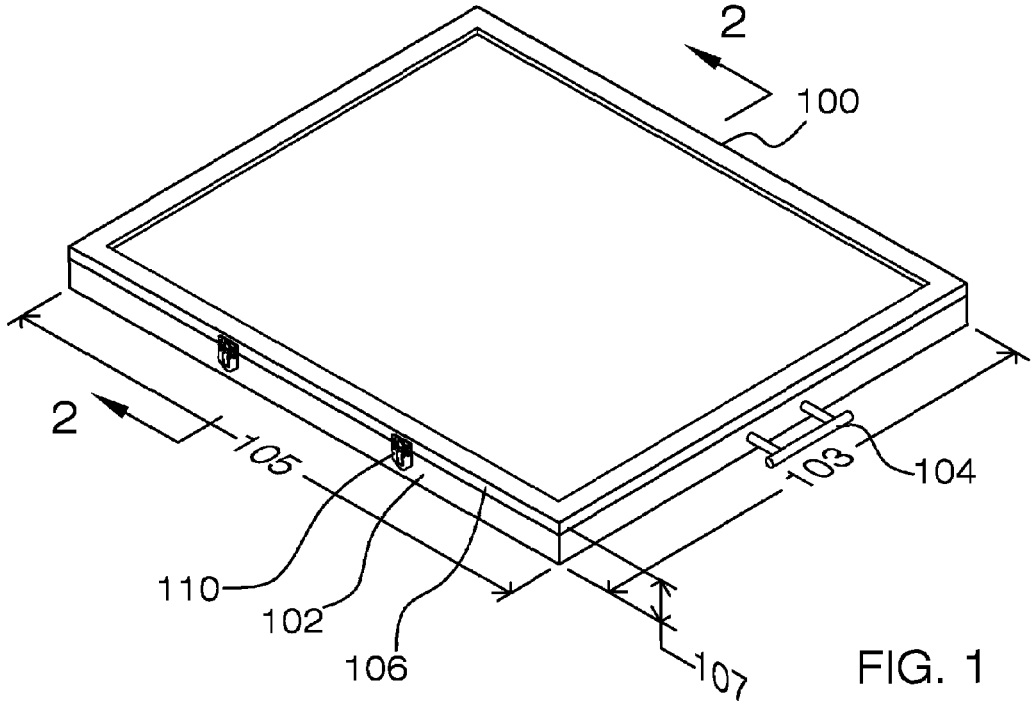
FIG. 1 is an isometric view of a container 100.

FIG. 1 is an isometric view of a container 100. Container 100 may be a portable enclosure for carrying several objects. For example, container 100 may be a portable container to store jigsaw puzzle pieces and to provide support in assembling the store jigsaw puzzle pieces.

Figure 2:
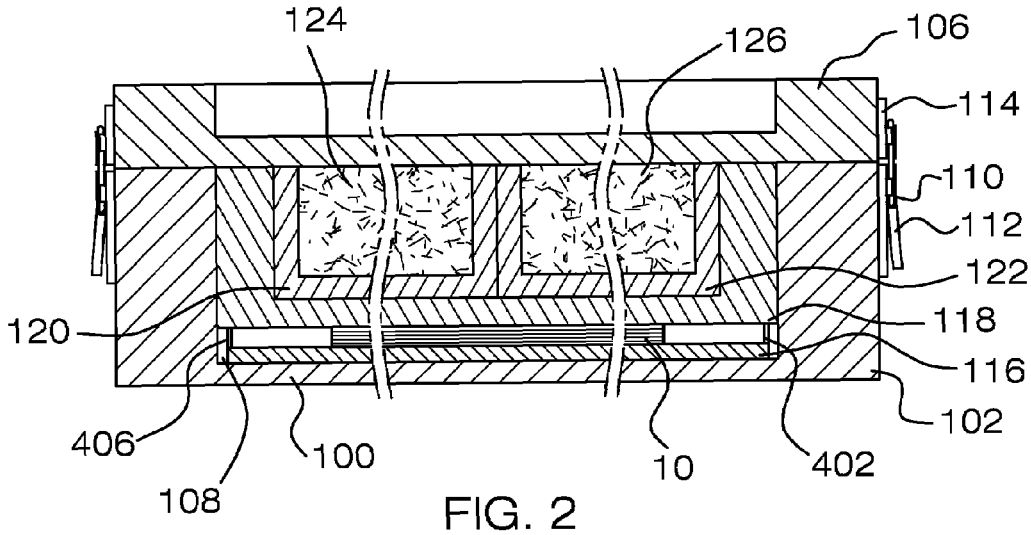
FIG. 2 is a sectional view of container 100 taken off of line 2-2 of FIG. 1.

Container 100 may include a main tray 102 having a handle 104 and configured to receive an outer lid 106 to form a container interior 108 (FIG. 2). Container 100 additionally may include fasteners 110 that may be configured to secured outer lid 106 to main tray 102. In one example, container 100 includes four fasteners 110. In another example, at least one of fasteners 110 may be a latch fastener.

Container 100 may have an overall rectangular shape. Container 100 may have a length 103, a width 105, and a height 107. In one example, substantially length 103 may be 36-inches, width 105 may be 32-inches, and height 107 may be 2½ to 3½ inches.

FIG. 2 is a sectional view of container 100 taken off of line 2-2 of FIG. 1. Fasteners 110 may include a tongue 112 configured to engage and be removeably secured to a strike 114. Container 100 additionally may include a puzzle support 116, an inner lid 118, a first tray 120, a second tray 122, a first foam pad 124, and a second foam pad 126, each of which may be configured to be positioned within container interior 108.

Puzzle support 116 may support a puzzle 10 and removeably reside in main tray 102. Inner lid 118 may sandwich puzzle 10 to puzzle support 116. First tray 120 and second tray 122 may provide more storage space for additional puzzles or puzzle pieces. First foam pad 124 and second foam pad 126 may be inserted with first tray 120 and second tray 122 respectively. With outer lid 106 secured to main tray 102, outer lid 106 may compress first foam pad 124 and second foam pad 126 to provide a resilient squeeze on puzzle 10 that may secure puzzle 10 in place.

Figure 3:
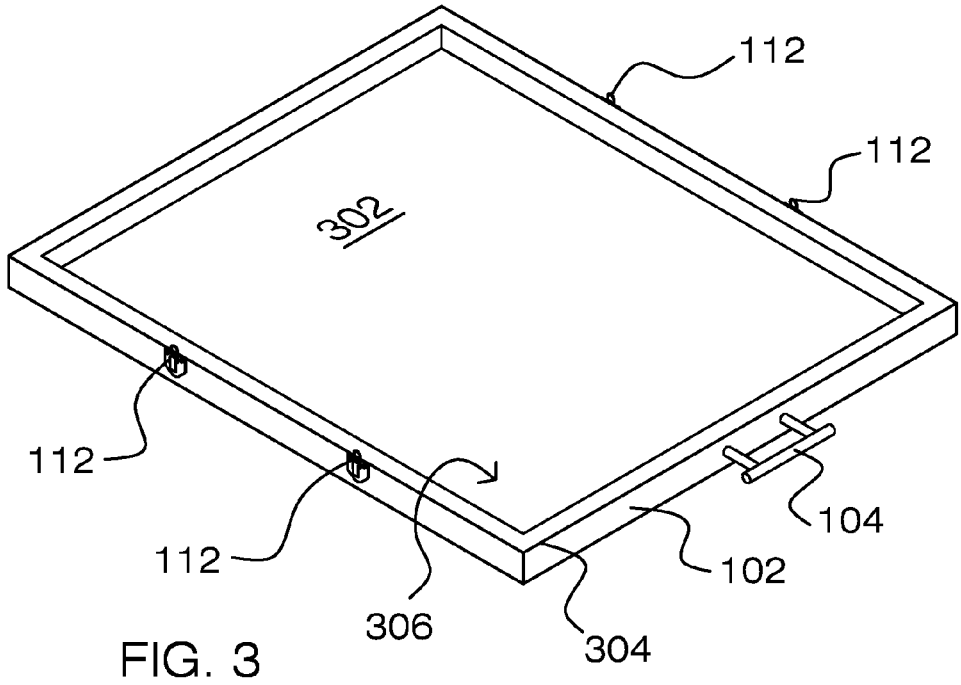
FIG. 3 is an isometric view of main tray 102.

FIG. 3 is an isometric view of main tray 102. Main tray 102 may include a main tray base 302 surrounded by four sides 304. Four sides 304 may extend away from main tray base 302 in one direction to form a main tray cavity 306.

Figure 4:
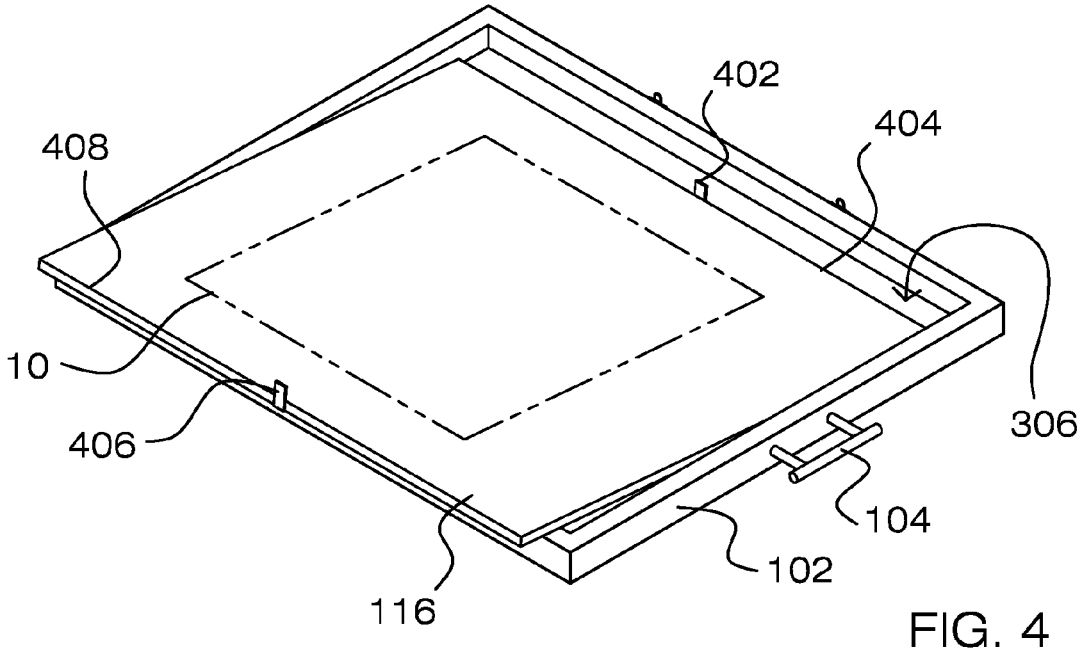
FIG. 4 is an isometric view of puzzle support 116 positioned relative to main tray 102.

FIG. 4 is an isometric view of puzzle support 116 positioned relative to main tray 102. As noted above, puzzle support 116 may support a puzzle 10 and removeably reside in main tray 102. Puzzle support 116 may be flat and may be made of stock cardboard.

Puzzle support 116 may have a rectangular shape and include tabs on all four sides of puzzle support 116. For example, puzzle support 116 may include a first tab 402 on a first side 404 of puzzle support 116 and a second tab 406 on a second side 408 of puzzle support 116 that may oppose first side 404. Puzzle support 116 may be moved in and out of main tray cavity 306 via first tab 402 and second tab 404.

Figure 5:
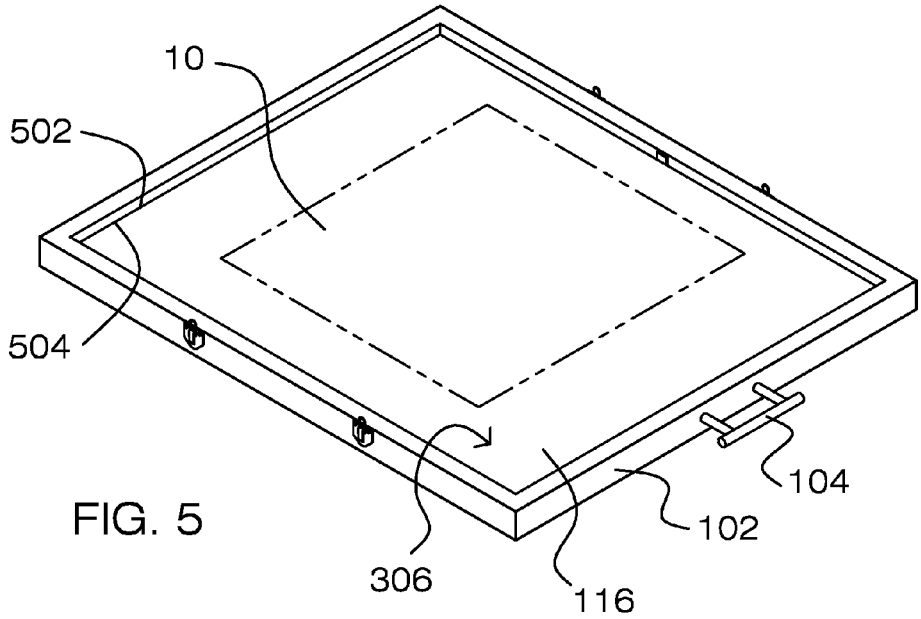
FIG. 5 is an isometric view of puzzle support 116 positioned inside main tray cavity 306 of main tray 102.

FIG. 5 is an isometric view of puzzle support 116 positioned inside main tray cavity 306 of main tray 102. Puzzle support 116 may have a puzzle support perimeter 502 that may be smaller than a main tray cavity perimeter 504 of main tray cavity 306. In one example, puzzle support perimeter 502 may be from one inch to three inches smaller than main tray cavity perimeter 504.

Figure 6:
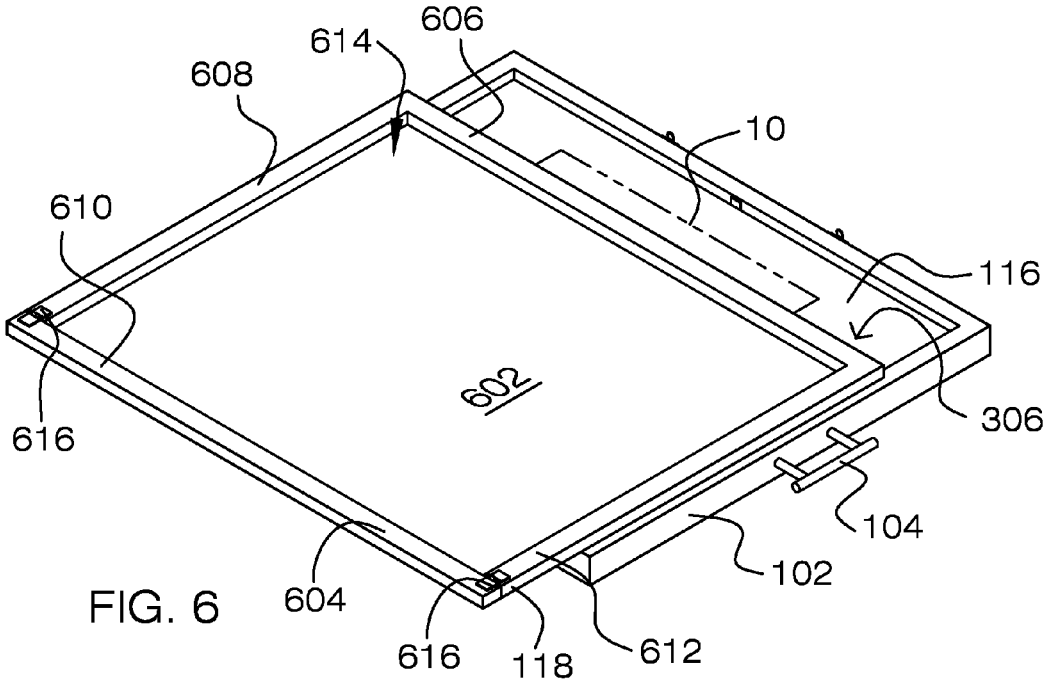
FIG. 6 is first isometric view of inner lid 118 positioned relative to main tray 102.
Figure 7:
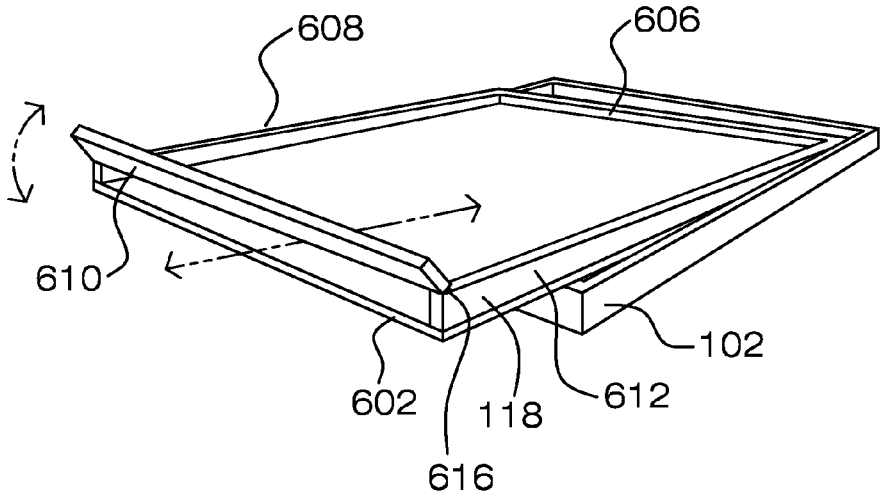
FIG. 7 is second isometric view of inner lid 118 positioned relative to main tray 102.
Figure 8:
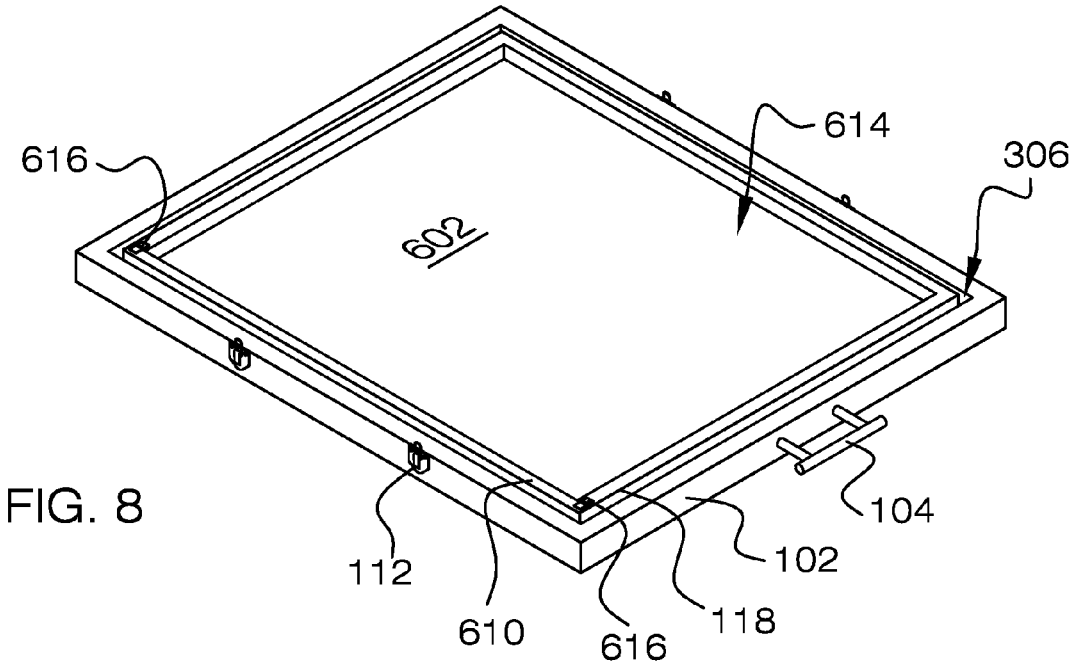
FIG. 8 is an isometric view of inner lid 118 positioned within main tray cavity 306 of main tray 102.

FIG. 6 is first isometric view of inner lid 118 positioned relative to main tray 102. FIG. 7 is second isometric view of inner lid 118 positioned relative to main tray 102. FIG. 8 is an isometric view of inner lid 118 positioned within main tray cavity 306 of main tray 102. Inner lid 118 may include an inner lid base 602 surrounded by inner lid sides 604, such as inner lid side 606, 606, 608, and 610. Inner lid sides 604 may extend away from inner lid base 602 in one direction to form an inner lid cavity 612.

Inner lid side 610 may be hinged to inner lid side 608 and inner lid side 612. Thus, inner lid side 610 may be raised away from inner lid base 602. This may permit a puzzle to be slid along inner lid base 602 and out of inner lid cavity 612. In assembly, inner lid 118 may fit within main tray cavity 306.

FIG. 9 is an isometric view of first tray 120 and second tray 122 positioned relative to inner lid 118 and main tray 102. FIG. 10 is an isometric view of first tray 120 and second tray 122 positioned in inner lid cavity 612 of inner lid 118.

First tray 120 may include a first tray base 902 (FIG. 9) surrounded by first tray sides 904. First tray sides 904 may extend away from first tray base 902 in one direction to form a first tray cavity 906. Second tray 122 may include a second tray base 908 surrounded by second tray sides 910. Second tray sides 910 may extend away from second tray base 908 in one direction to form a second tray cavity 912.

First tray 120 and second tray 122 may be similarly shaped and configured to fit within and fill inner lid cavity 612. Container 100 need not be limited to two such trays. Container 100 may include a number of trays that may be configured to fit within and fill inner lid cavity 612. In one example, container 100 may include three trays similarly shaped and configured to fit within and fill inner lid cavity 612. In another example, the three trays may have a triangular shape.

FIG. 11 is an isometric view of first foam pad 124 and second foam pad 126 positioned relative to first tray 120 and second tray 122. FIG. 12 is an isometric view of first foam pad 124 and second foam pad 126 positioned in first tray cavity 906 and second tray cavity 912, respectively.

First foam pad 124 and second foam pad 126 each may be shaped to fit snugly within first tray cavity 906 and second tray cavity 912, respectively. Each foam pad 124, 126 may be any lightweight material in cellular form, such as a polyurethane foam. Preferably, each foam pad 124, 126 may extend above its respective cavity 906, 912 such that a thickness of each foam pad 124, 126 may be greater than a depth of its respective cavity 906, 912.

Figure 13:
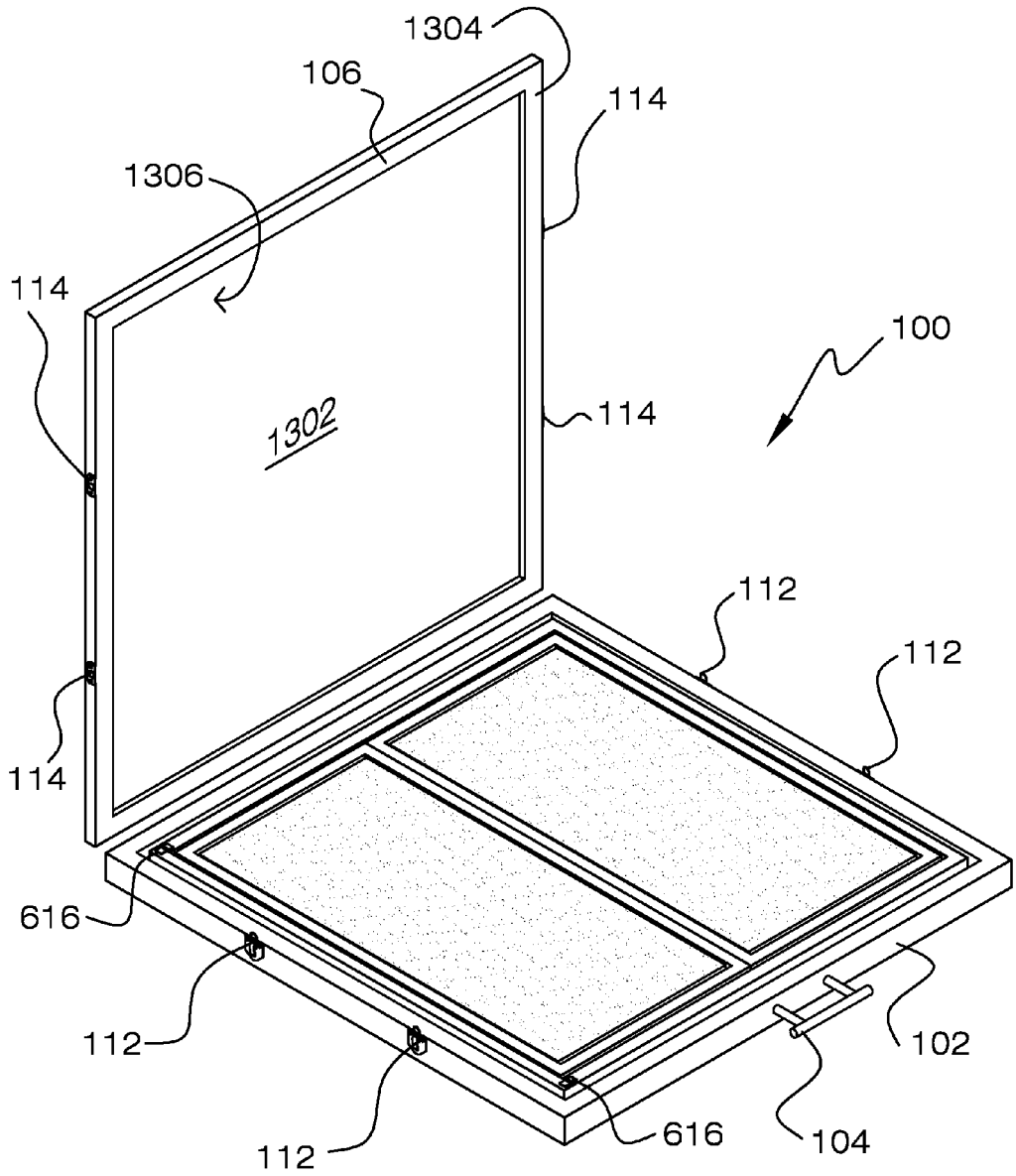
FIG. 13 is an isometric view of outer lid 106 positioned relative to main tray 102.
Figure 14:
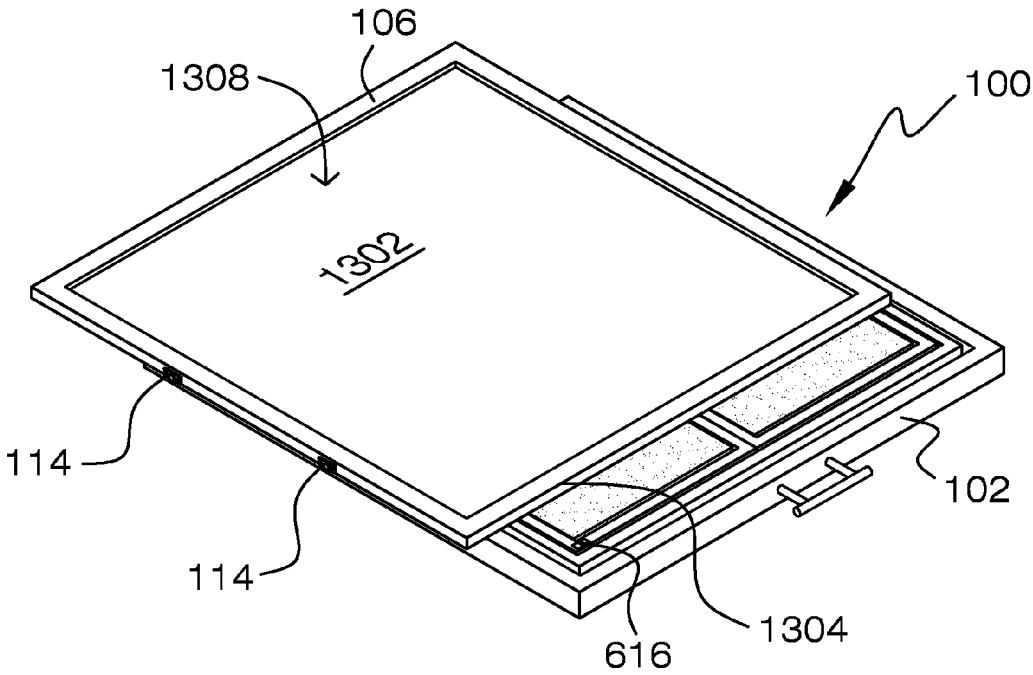
FIG. 14 is an isometric view of outer lid 106 positioned closer to and relative to main tray 102.
Figure 15:
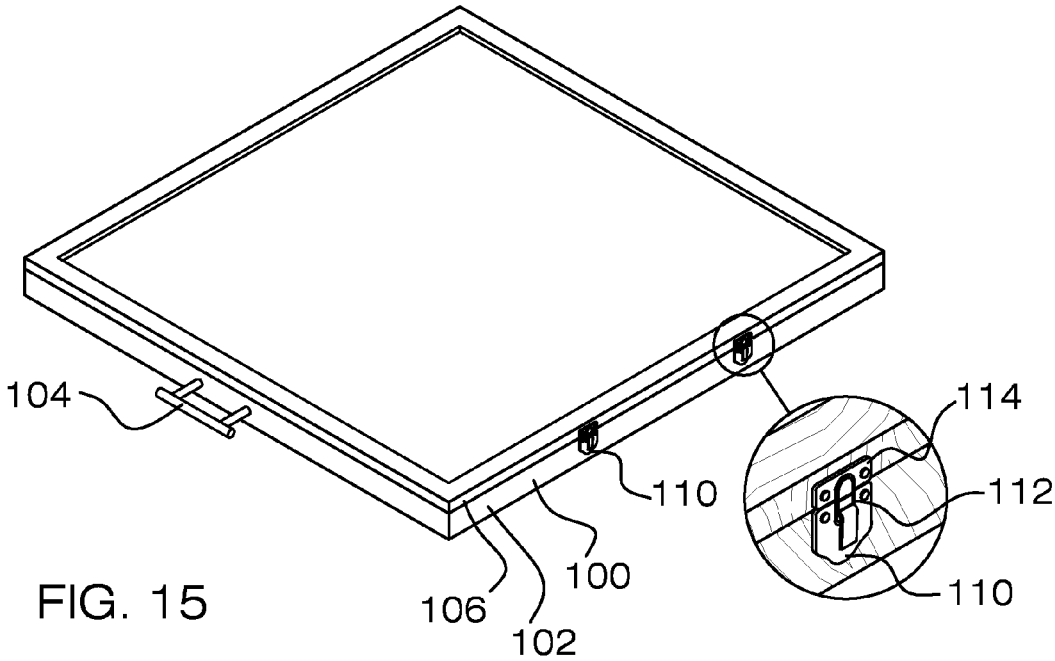
FIG. 15 is an isometric view of outer lid 106 positioned on and secured to main tray 102.

FIG. 13 is an isometric view of outer lid 106 positioned relative to main tray 102. FIG. 14 is an isometric view of outer lid 106 positioned closer to and relative to main tray 102. FIG. 15 is an isometric view of outer lid 106 positioned on and secured to main tray 102.

Outer lid 106 may include an outer lid base 1302 surrounded by outer lid sides 1304. Outer lid sides 1304 may extend away from outer lid base 1302 in two directions to form a first outer lid cavity 1306 and a second outer lid cavity 1308. With outer lid 106 positioned on and secured to main tray 102, each tongue 112 and strike 114 of fasteners 110 may be secured together to secure outer lid 106 and main tray 102 together (FIG. 15).

The container may be a device configured to protect a completed or semi-completed jigsaw puzzle. The container may provide a user with a convenient means to store or work on a jigsaw puzzle.

The container may consist of a wooden or plastic unit that substantially may measure approximately 32 inches high, 36 inches long, and 2½ to 3½ inches thick. The container may feature a main top working surface as well as a hinged top lid that may lock onto the top of the container. This may assist in pressing all work areas securely into place for transport.

In one example, the top of the container may be transparent for easy viewing of the puzzle. This may allow use of the container to display a completed puzzle. The container may also feature several trays to allow it to sort pieces for and store up to three different puzzles.

To use the container, a consumer may simply work on the puzzle on a surface of the container. When the consumer desires to take a break, or if the puzzle is finished, the lid may be placed over the puzzle. The puzzle may then be moved and stored without the consumer having to worry about it being damaged by an accidental bump or fall.

The container may fulfill the need for a convenient means to protect a semi completed or completed jigsaw puzzle. The appealing features of the container may be its convenience, ease in use, effectiveness in storing a puzzle, and ability to provide a convenient place on which to assemble the puzzle. Also appealing may be its durable construction and reasonable cost. The container may allow an individual to store a puzzle safely and conveniently. Its use may prevent clutter in the home by minimizing a need to keep a puzzle out in the open on a table or desk. In addition, the container may prevent frustration that may result if the puzzle were to be bumped, causing much of the work already completed to be damaged. The container also may allow the puzzle to be moved easily. The container may be the perfect gift item for those individuals who enjoy completing jigsaw puzzles.

The container may be configured to hold three separate jigsaw puzzles at a time while providing at least one sorting tray. The puzzles may be carried in the container without being messed up as they may stay in one place within the container. A bottom tray may be removed via tabs to assist in removing a puzzle in tact, to glue, or place on another format. A height may be 32 inches, a length may be 36 inches, and a thickness may be 2.5 to 3.5 inches. A shape may be rectangular, and materials used may include wood and plastic. Four foldable legs or a bifold stand may be added to the container to make the container into a table.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A container for carrying jigsaw puzzle pieces, the container comprising:

a main tray having a handle and a main tray cavity;

an outer lid secured to the main tray by fasteners to form a container interior with the main tray cavity;

an inner lid positioned within the main tray cavity, where the inner lid includes an inner lid cavity;

a puzzle support removeably residing in the main tray cavity between the main tray and the inner lid, where the puzzle support includes a first tab on a first side of the puzzle support and a second tab on a second side of the puzzle support that opposes the first side of the puzzle support;

a first tray positioned within the inner lid cavity, where the first tray includes a first tray cavity;

a second tray positioned within the inner lid cavity adjacent to the first tray, where the second tray includes a second tray cavity;

a first foam pad position in the first tray cavity and compressed between the outer lid and the first tray; and a second foam pad positioned in the second tray cavity and compressed between the outer lid and the second tray.

2. The container of claim 1, where the inner lid includes a first inner lid side, a second inner lid side, a third inner lid side, and an inner lid base, where the first inner lid side is hinged to the second inner lid side and the third inner lid side such that the first inner lid side is configured to be raised away from and lowered towards the inner lid base.

3. The container of claim 2, where the first foam pad and the second foam pad each are shaped to fit snugly within the first tray cavity and the second tray cavity, respectively.

4. The container of claim 3, where the first tray and second tray are similarly shaped and configured to fit within and fill the inner lid cavity.

5. The container of claim 4, where the outer lid includes a first outer lid cavity and a second outer lid cavity, where the first foam pad is position in the first outer lid cavity.

6. The container of claim 1, where the container has a length, a width, and a height, where substantially the length is 36-inches, the width is 32-inches, and the height is 2½ to 3½ inches.

7. The container of claim 6, where the puzzle support is flat.

8. The container of claim 7, where the puzzle support has a puzzle support perimeter that is one inch to three inches smaller than a main tray cavity perimeter of the main tray cavity.

9. The container of claim 8, where the fasteners are four latch fasteners.

10. A container for carrying jigsaw puzzle pieces, the container comprising:

a main tray having a main tray cavity;

an outer lid secured to the main tray by fasteners to form a container interior with the main tray cavity;

an inner lid positioned within the main tray cavity, where the inner lid includes an inner lid cavity;

a puzzle support removeably residing in the main tray cavity between the main tray and the inner lid, where the puzzle support includes a first tab on a first side of the puzzle support and a second tab on a second side of the puzzle support that opposes the first side of the puzzle support;

a first tray positioned within the inner lid cavity, where the first tray includes a first tray cavity;

a second tray positioned within the inner lid cavity adjacent to the first tray, where the second tray includes a second tray cavity;

a first foam pad position in the first tray cavity and compressed between the outer lid and the first tray, where the outer lid includes a first outer lid cavity and a second outer lid cavity, where the first foam pad is position in the first outer lid cavity; and a second foam pad positioned in the second tray cavity and compressed between the outer lid and the second tray.

11. The container of claim 10, where the inner lid includes a first inner lid side, a second inner lid side, a third inner lid side, and an inner lid base, where the first inner lid side is hinged to the second inner lid side and the third inner lid side such that the first inner lid side is configured to be raised away from and lowered towards the inner lid base.

12. The container of claim 11, where the first foam pad and the second foam pad each are shaped to fit snugly within the first tray cavity and the second tray cavity, respectively.

13. The container of claim 12, where the first tray and second tray are similarly shaped and configured to fit within and fill the inner lid cavity.

14. The container of claim 13, where the container has a length, a width, and a height, where substantially the length is 36-inches, the width is 32-inches, and the height is 2½ to 3½ inches, where the puzzle support is flat, where the puzzle support has a puzzle support perimeter that is one inch to three inches smaller than a main tray cavity perimeter of the main tray cavity, and where the fasteners are four latch fasteners.

* * * * *